US006857892B2

(12) United States Patent
McLauchlan et al.

(10) Patent No.: US 6,857,892 B2
(45) Date of Patent: Feb. 22, 2005

(54) ELECTRICAL CONNECTOR WITH CONNECTOR POSITION ASSURANCE MEMBER

(75) Inventors: Raymond Bruce McLauchlan, Macomb Township, MI (US); Gregory David Leece, Southgate, MI (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/456,368

(22) Filed: Jun. 5, 2003

(65) Prior Publication Data

US 2004/0248453 A1 Dec. 9, 2004

(51) Int. Cl.[7] ..... H01R 13/627
(52) U.S. Cl. ..... 439/352
(58) Field of Search ..... 439/352, 489, 439/350, 353–358

(56) References Cited

U.S. PATENT DOCUMENTS

| | | | | |
|---|---|---|---|---|
| 4,714,433 A | | 12/1987 | Rider, Jr. | 439/310 |
| 4,906,204 A | | 3/1990 | Metzger | 439/352 |
| 5,120,240 A | * | 6/1992 | Reider | 439/352 |
| 5,236,373 A | | 8/1993 | Kennedy | |
| 5,241,910 A | | 9/1993 | Cunningham et al. | |
| 5,257,944 A | | 11/1993 | Kennedy | |
| 5,275,575 A | | 1/1994 | Cahaly et al. | 439/188 |
| 5,288,242 A | | 2/1994 | Muzslay | |
| 5,314,345 A | | 5/1994 | Cahaly et al. | |
| 5,605,471 A | | 2/1997 | Plyler | 439/489 |
| 5,616,045 A | | 4/1997 | Gauker | |
| 5,681,178 A | | 10/1997 | Kunkle et al. | 439/352 |
| 5,685,743 A | | 11/1997 | Schmidt et al. | 439/701 |
| 5,688,141 A | | 11/1997 | Dullin | 439/352 |
| 5,775,930 A | | 7/1998 | Model et al. | 439/352 |
| 5,827,083 A | | 10/1998 | Dullin | 439/188 |
| 5,863,214 A | | 1/1999 | Hanak | 439/352 |
| 5,895,282 A | | 4/1999 | Little | |
| 5,924,885 A | | 7/1999 | Pacher | 439/352 |
| 5,947,763 A | * | 9/1999 | Alaksin | 439/489 |
| 5,993,230 A | | 11/1999 | Gauker et al. | |
| 6,004,153 A | | 12/1999 | Myer et al. | 439/352 |
| 6,045,404 A | | 4/2000 | Myer | 439/595 |
| 6,109,955 A | | 8/2000 | Hanazaki et al. | 439/489 |
| 6,126,482 A | | 10/2000 | Stabile | |
| 6,149,448 A | | 11/2000 | Haller et al. | |
| 6,234,826 B1 | | 5/2001 | Wilber et al. | 439/352 |
| 6,250,952 B1 | | 6/2001 | Shiga et al. | |
| 6,261,115 B1 | | 7/2001 | Pederson et al. | 439/352 |
| 6,261,116 B1 | * | 7/2001 | Ceru | 439/352 |
| 6,276,953 B1 | | 8/2001 | Gauker et al. | 439/352 |

(List continued on next page.)

FOREIGN PATENT DOCUMENTS

| | | |
|---|---|---|
| DE | 4317344 A1 | 1/1994 |
| DE | 19617792 A1 | 11/1997 |

(List continued on next page.)

*Primary Examiner*—Gary Paumen
(74) *Attorney, Agent, or Firm*—Harrington & Smith, LLP

(57) ABSTRACT

An electrical connector including a housing; electrical contacts connected to the housing; and a connector position assurance (CPA) member movably attached to the housing. The housing includes a deflectable latch for latching with a mating electrical connector. The CPA member includes two deflectable side arms and a center section located between the side arms. The CPA member is movable between a first position and a second position. The first position has the center section spaced from the deflectable latch and outwardly extending portions of the side arms extending through first holes in the housing to an exterior side of the housing. The second position comprises a portion of the center section being located beneath a portion of the latch with the latch to prevent the latch from being deflected inward, and the outwardly extending portions being moved out of the first holes.

15 Claims, 6 Drawing Sheets

U.S. PATENT DOCUMENTS

| | | | | |
|---|---|---|---|---|
| 6,290,539 | B1 | 9/2001 | Wilber et al. | 439/595 |
| 6,328,589 | B1 | 12/2001 | Annecke | |
| 6,354,860 | B1 | 3/2002 | Miller et al. | 439/352 |
| 6,361,348 | B1 | 3/2002 | Hall et al. | |
| 6,364,683 | B1 | 4/2002 | Kohno | 439/352 |
| 6,383,036 | B1 | 5/2002 | Steinhauser et al. | 439/752 |
| 6,406,319 | B2 * | 6/2002 | Pederson et al. | 439/352 |
| 6,435,895 | B1 * | 8/2002 | Fink et al. | 439/352 |
| 6,514,098 | B2 * | 2/2003 | Marpoe et al. | 439/352 |
| 6,530,785 | B1 | 3/2003 | Hwang | 439/76.1 |
| 6,705,886 | B1 * | 3/2004 | Brown | 439/489 |
| 6,716,052 | B2 * | 4/2004 | Kane | 439/352 |
| 2002/0111059 | A1 | 8/2002 | Raudenbush et al. | 439/352 |
| 2002/0115332 | A1 | 8/2002 | Myer et al. | 439/352 |
| 2003/0049962 | A1 | 3/2003 | Raudenbush et al. | 439/489 |

FOREIGN PATENT DOCUMENTS

| | | | |
|---|---|---|---|
| DE | 10032234 | A1 | 1/2002 |
| DE | 10151956 | A1 | 7/2002 |
| EP | 0112429 | A1 | 12/1982 |
| EP | 0591948 | B1 | 1/1997 |
| EP | 0591947 | B1 | 3/1997 |
| EP | 1124291 | A2 | 8/2001 |
| EP | 1130692 | A2 | 9/2001 |
| EP | 12007591 | A2 | 5/2002 |

* cited by examiner

ELECTRICAL CONNECTOR WITH CONNECTOR POSITION ASSURANCE MEMBER

BACKGROUND OF THE INVENTION

1. Field of the Invention

The present invention relates to electrical connectors and, more particularly, to a connector position assurance system for use with a latch on an electrical connector.

2. Brief Description of Prior Developments

Electrical connectors having snap-lock latches and connector position assurance (CPA) members are generally well known in the art. One type of snap-lock latch uses a sleeve type connection locking design. A sleeve type connection locking design uses a window in the sleeve of a mating connector to attach. A typical axial CPA for a locking ramp type design does not work for window type locking. Once the typical CPA is engaged after assembly with the mating connector, the primary latch is free to lift when depressed.

There is a need for a CPA connection system which can be used in a sleeve type connection locking design which helps to prevent the primary latch from opening once the CPA member is locked in an actuated position. There is also a need for an axial CPA connection system which has a stubbing feature to prevent the CPA member from being moved from an unlocked preassembly position, but which has the stubbing feature reduced once the electrical connector is attached to a mating connector.

SUMMARY OF THE INVENTION

In accordance with one aspect of the present invention, an electrical connector is provided including a housing; electrical contacts connected to the housing; and a connector position assurance (CPA) member movably attached to the housing. The housing includes a deflectable latch for latching with a mating electrical connector. The CPA member includes two deflectable side arms and a center section located between the side arms. The CPA member is movable between a first position and a second position. The first position has the center section spaced from the deflectable latch and outwardly extending portions of the side arms extending through first holes in the housing to an exterior side of the housing. The second position comprises a portion of the center section being located beneath a portion of the latch to prevent the latch from being deflected inward, and the outwardly extending portions being moved out of the first holes.

In accordance with another aspect of the present invention, an electrical connector is provided comprising a housing; electrical contacts connected to the housing; and a connector position assurance (CPA) member movably attached to the housing. The housing comprising a deflectable latch for latching with a mating electrical connector and a CPA member receiving area located beneath the deflectable latch. The housing comprises first holes and second holes extending laterally outward from the CPA member receiving area. The CPA member comprises two deflectable side arms and a center section having a general wedge shape and being located between the side arms. The CPA member is movable between a first position and a second position. The first position comprises the center section being spaced from the deflectable latch and outwardly extending portions of the side arms extending through the first holes in the housing to an exterior side of the housing. The second position comprises a portion of the center section being located beneath a portion of the latch with the latch in a home position to prevent the latch from being deflected inward, and the outwardly extending portions being moved from the first holes to the second holes. The CPA member is blocked by the latch from moving from the first position to the second position unless the latch is located at the home position.

In accordance with another aspect of the present invention, an electrical connector is provided comprising a housing; and electrical contacts connected to the housing. The housing comprises a deflectable latch for latching with a mating electrical connector. The latch is resiliently movable from a latching home position in an inward direction. The electrical connector further comprises a connector position assurance (CPA) member movably attached to the housing, the CPA member comprising two deflectable side arms and a general wedge shaped center section located between the side arms, wherein the CPA member is movable between a first position and a second position. The connector includes means for preventing the latch from moving from its latching home position when the CPA member is at the second position; means for preventing the CPA member from being moved from the first position to the second position unless the latch is at the latching home position; and means for preventing the CPA member from being moved from the first position to the second position unless the housing is mated with a housing of a mating electrical connector. The first position comprises the center section being spaced from the deflectable latch and outwardly extending portions of the side arms extending through first holes in the housing to an exterior side of the housing. The second position comprises a portion of the center section being located beneath a portion of the latch with the latch in a home position to prevent the latch from being deflected inward and the outwardly extending portions being moved out of the first holes.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
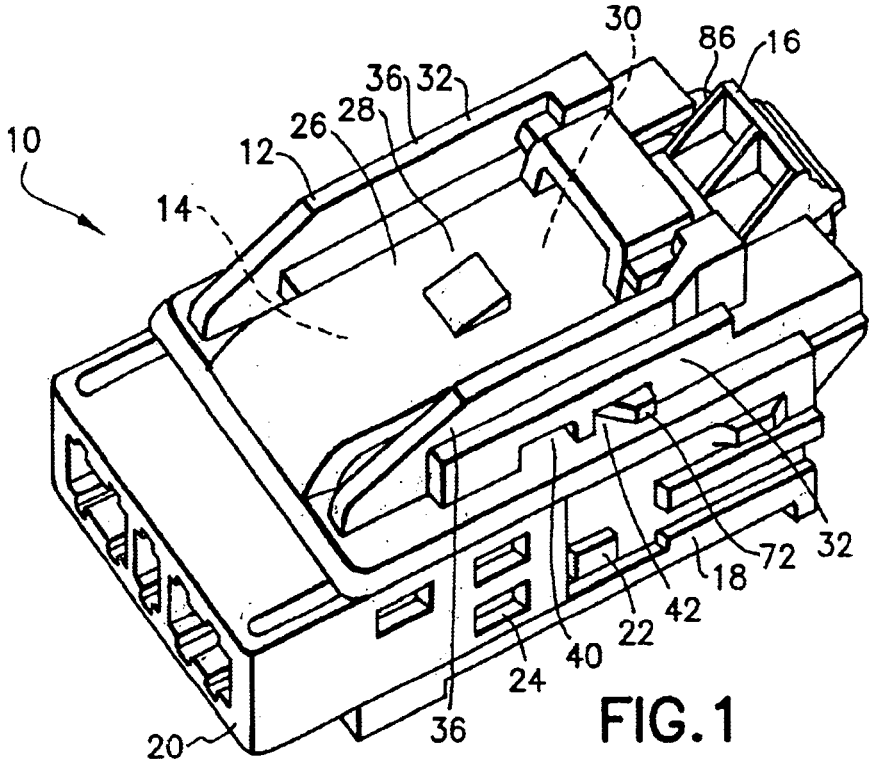
FIG. 1 is a top, front and left side perspective view of an electrical connector incorporating features of the present invention.

Referring to FIG. 1, there is shown a perspective view of an electrical connector 10 incorporating features of the present invention. Although the present invention will be described with reference to the exemplary embodiment shown in the drawings, it should be understood that the present invention can be embodied in many alternate forms of embodiments. In addition, any suitable size, shape or type of elements or materials could be used.

The CPA device of the present invention helps to solve the problem of assuring that a full mating connection between two connector assemblies has been made and remains intact after the initial assembly. More specifically, two electrical connector assemblies can be provided that meet with USCAR standards wherein the latching connector assembly utilizes a cantilever beam construction for the latch.

The connector position assurance (CPA) device of the present invention can be located entirely on the first of two or more interlocking connectors. The CPA device can be initiated only after the mating connector assemblies are fully engaged to a locked position. Once the CPA device has been shifted forward into the active position, a stop pad centrally located on the CPA device positions itself beneath the cantilever beam latch and restricts enough downward motion of the latch to keep the latch from releasing the two mating connectors. This design also allows for a configuration of ribs set on an incline to assist in the prevention of downward compression of the latch as well as supply a minimal amount of constant force directed conversely for the purpose of retaining better positional memory on the latch and providing improved surface contact for the latch shelf engagement. Simultaneous to the stop pad being engaged, the two side latches on the CPA device are transferred to a second set of clearance holes or windows for a positive tactile lock. The secondary windows are designed such that a marginally noticeable increased amount of force is required to disengage the CPA device back to its original preloaded condition.

Figure 2:
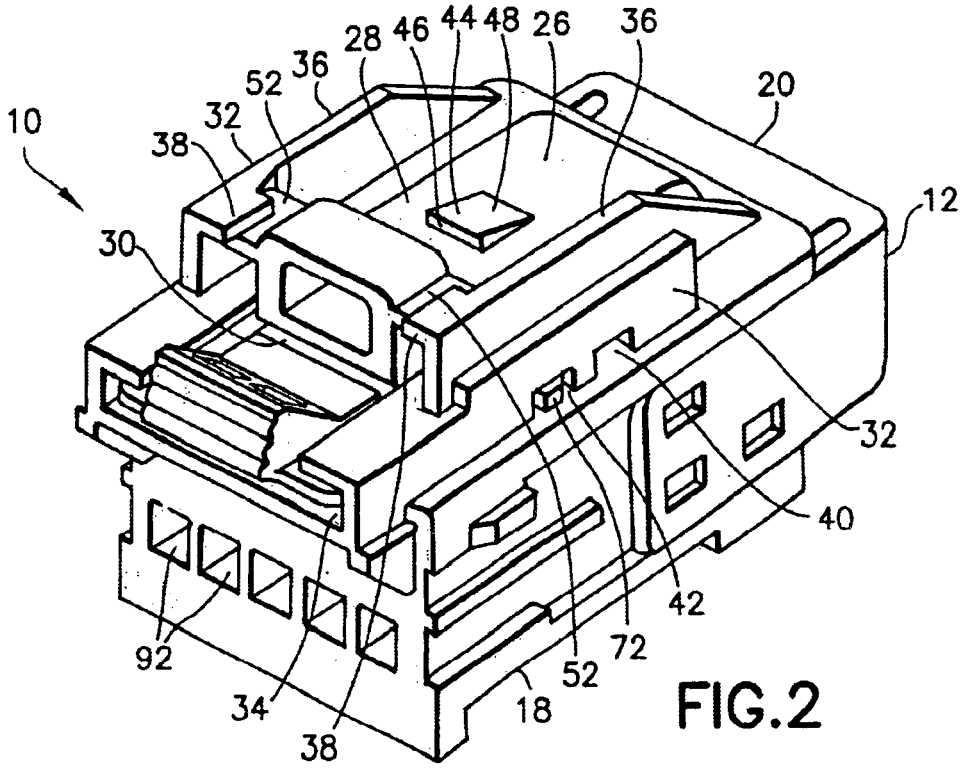
FIG. 2 is a top, rear and right side perspective view of the electrical connector shown in FIG. 1.
Figure 3:
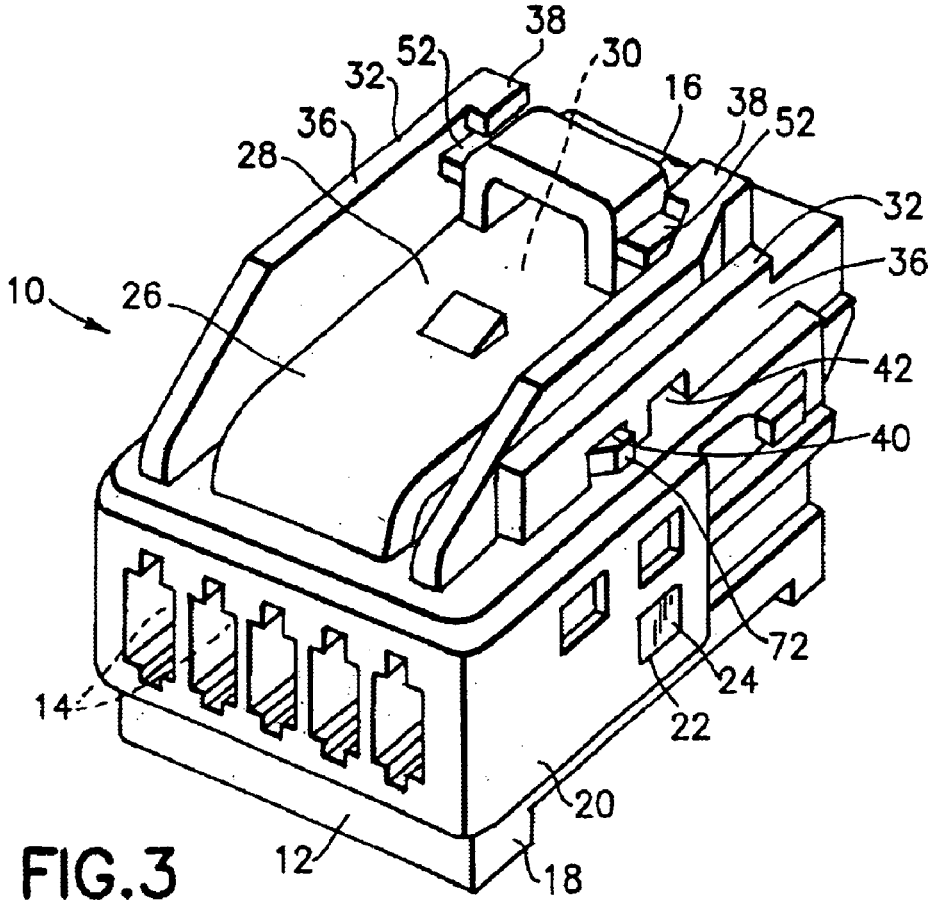
FIG. 3 is a top, front and left side perspective view of the electrical connector shown in FIG. 1 with the second housing member moved to a connected position and the CPA member moved to a front position.

Referring also to FIGS. 2 and 3, the electrical connector 10 generally comprises a housing 12, electrical contacts 14, and a connector position assurance (CPA) 16. The housing 12 generally comprises a first member 18 and a second member 20. The housing 12 is preferably comprised of a dielectric material, such as a molded plastic or polymer material. However, any suitable type of material(s) could be used. For example, the second member 20 could be comprised of an electromagnetic shielding material, such as metal. In the embodiment shown, the second member 20 is movably mounted on the first member 18.

FIG. 1 shows the second member 20 at an extended position before the electrical connector 10 is mated with a mating electrical connector (not shown). FIG. 3, on the other hand, shows the position of the second member 20 relative to the first member 18 corresponding to the position of the first and second members after connection to the mating electrical connector. The second member 20 is adapted to slide rearwardly on the first member 18. The first and second members 18, 20 include latches 22, 24 for fixedly latching the first and second members in their collapsed configuration shown in FIG. 3. The second member 20 is slid rearwardly on the first member 18 by contact with the mating electrical connector. In an alternate embodiment, the housing might not comprise two housing members movably attached to each other.

In the embodiment shown, the first housing member 18 includes a top side 26 with a mating connector latch 28. The first housing 18 also forms a CPA member receiving area 30 (see FIG. 2) located under the latch 28. The top side 26 also includes a two side sections 32 located on opposite sides of the receiving area 30. As seen best in FIG. 2, each side section 32 forms a side channel 34 on opposite sides of the receiving area 30. Each side section 32 comprises an upstanding section 36. Each upstanding section 36 comprises a front aperture 40 and a rear aperture 42 extending from the receiving area 30 to an exterior lateral side. Each side section 32 also comprises a cantilevered inward projecting ledge 38 at the top rear ends of the upstanding section 36.

Figure 8:
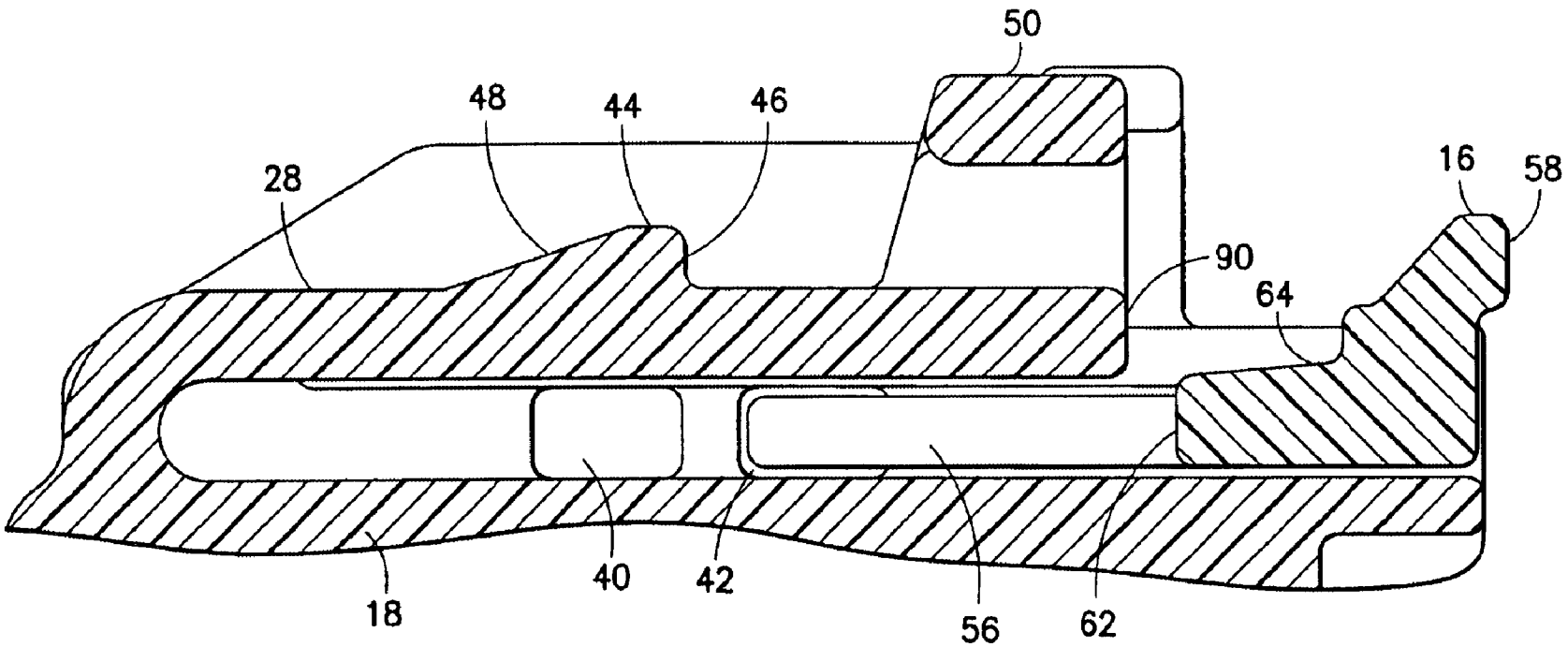
FIG. 8 is a partial cross sectional view of the latch and the CPA member at a home position as shown in FIGS. 1 and 2.

The latch 28, as seen in FIG. 8, is integrally formed with the rest of the first member 18. The latch 28 extends from the top surface of the first member 18 in a general cantilevered fashion. More specifically, the latch 28 extends upward at a front end of the first member 18 and then extends reward. The latch 28 includes a latch projection 44 on its top side. The latch projection 44 includes a rearward facing latch surface 46 and a forward and upward facing ramp surface 48. The rear end of the latch 44 includes a loop section 50 and side ledges 52. The side ledges 52 extend in lateral directions from the top of the loop section 50.

FIGS. 1–3 and 8 show the latch 28 in a home position. In this home position, the ledges 52 are located below the ledges 38. The ledges 58 function as an upward stop limit to limit the upward movement of the latch 28 relative to the rest of the first housing member 18. The loop section 50 provides structural stability or a structural frame across the span connecting the two ledges 52.

Figure 9:
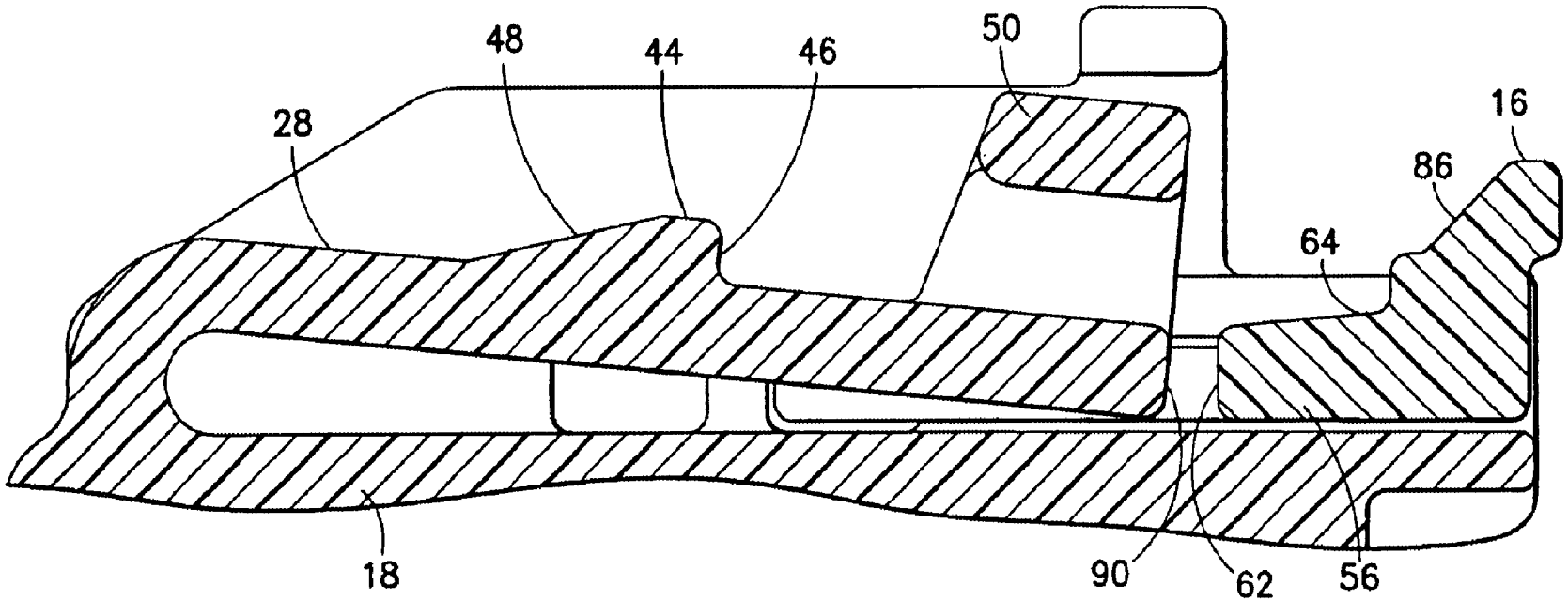
FIG. 9 is a partial cross sectional view as in FIG. 8 with the latch moved to an inwardly deflected position.

As seen in FIG. 9, the latch 28 can be deflected inwardly in a general cantilevered fashion as shown. The inward deflection of the latch 28 occurs when the electrical connector 10 is being mated to the mating electrical connector. More specifically, a portion of the mating electrical connector contacts the ramp surface 48 of the latch projection 44 and wedges the latch 28 inward as shown in FIG. 9. The mating electrical connector comprises a latch receiving area for receiving the latch projection 44. When the latch projection 44 comes into registration with the latch receiving area in the mating electrical connector, the latch 28 resiliently snaps back to its home position with the latch projection 44 being received in the latch receiving area of the mating electrical connector.

The latch surface 46 of the latch projection 44 contacts a surface in the latch receiving area of the mating electrical connector to prevent the housings of the two electrical connectors from being inadvertently or unintentionally disengaged. When the CPA member 16 is in a rearward position as shown in FIGS. 1, 2 and 9, the latch 28 can be manually depressed by a user merely pressing on the top of the loop section 50 to move the latch 28 to the depressed, unlatched position. The user can then disengage the two electrical connectors from each other.

The electrical contacts 14 are generally adapted to connect to individual electrical conductors, such as electrical wires, which enter the housing 12 from the rear end of the housing. The electrical contacts 14 could comprise front ends which comprise either male contact sections or female contact sections. The electrical contacts 14 can preferably be inserted into the housing 12 through the rear ends of contact receiving apertures 92 (see FIG. 2).

Figure 4:
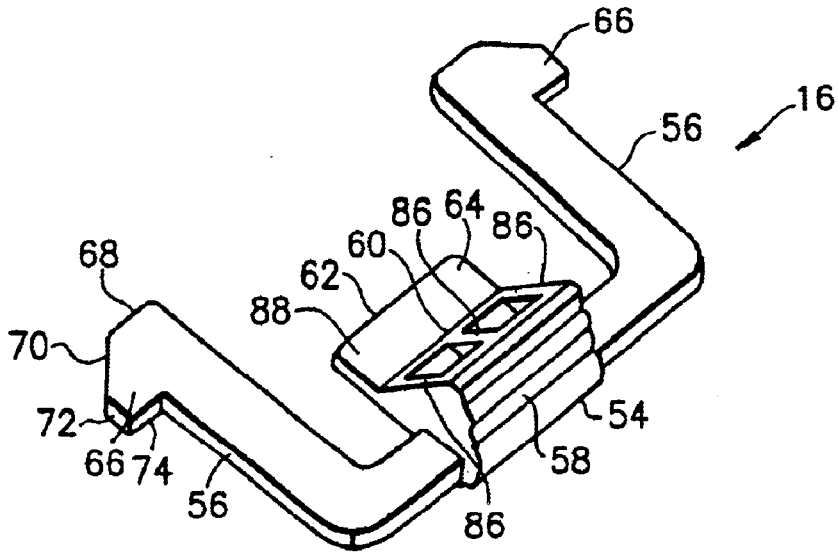
FIG. 4 is a perspective view of the CPA member used in the electrical connector shown in FIGS. 1–3.
Figure 10:
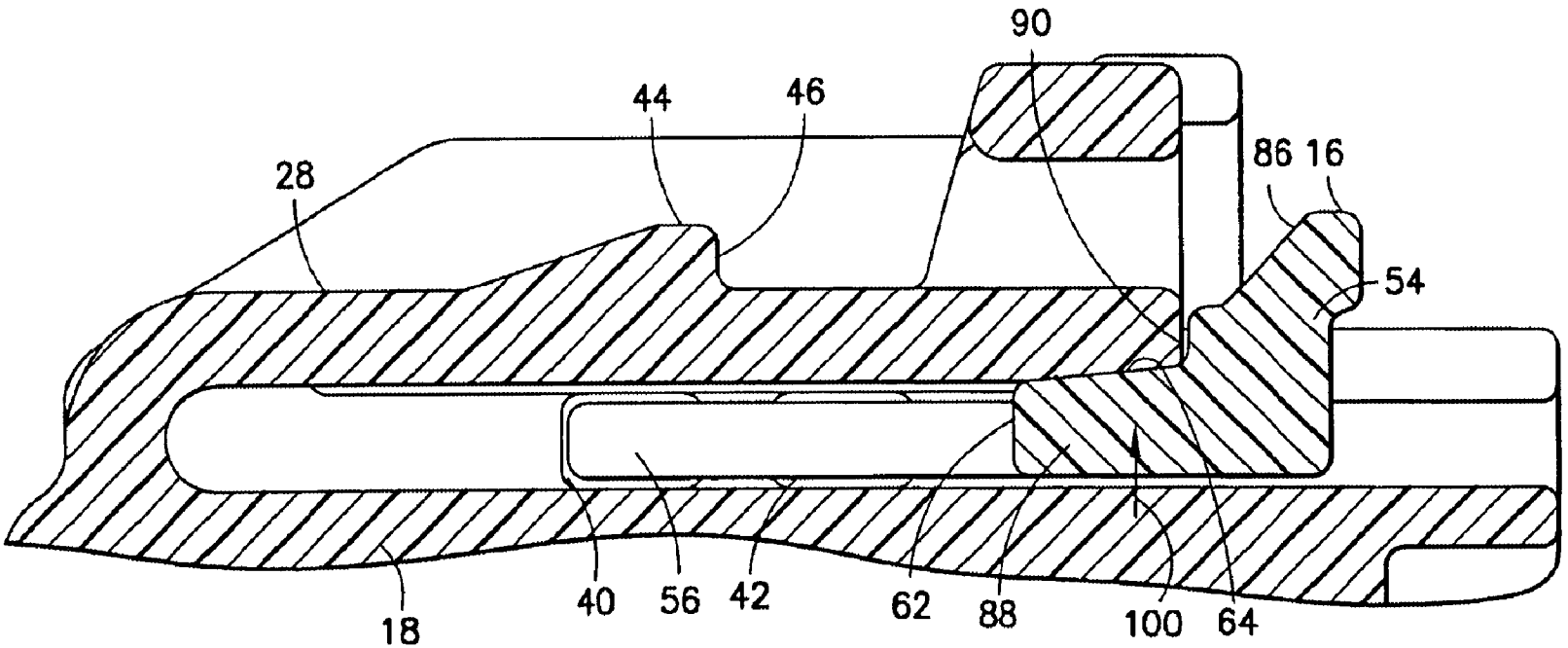
FIG. 10 is a partial cross sectional view as in FIG. 8 with the CPA member moved to its forward position.

Referring now also to FIG. 4, a perspective view of the CPA member 16 is shown. The CPA member 16 comprises a one-piece member formed from a suitable material, such as plastic or molded polymer material. In an alternate embodiment, the CPA member could be comprised of multiple components and any suitable type of material(s) could be used. The CPA member 16 generally comprises a center section 54 and two side arms 56. The center section 54 is located between the side arms 56. More specifically, the side arms 56 extend laterally outward and then forward relative to the center section 54. The CPA member 16 is movably mounted to the first housing member 18 in the receiving area 30. More specifically, the CPA member 16 is slidable on the first housing member 18 from a first rear position as shown in FIGS. 1, 2 and 8 to a second forward position as shown in FIGS. 3 and 10.

The center section 54 includes a rear pushing surface 58 and a front surface 60. The front surface 60 includes a lower stop surface 62 and an upper ramp surface 64. The two side arms 56 are substantially mirror images of each other. Each side arm 56 extends in a general cantilever fashion in a forward direction. Each side arm 56 includes a front end with an outwardly extending portion 66. Each outwardly extending portion 66 includes a front stop surface 68, a ramp surface 70, a tip 72, and a latch surface 74. Each side arm 56 is inwardly deflectable in a general cantilevered fashion.

Figure 5:
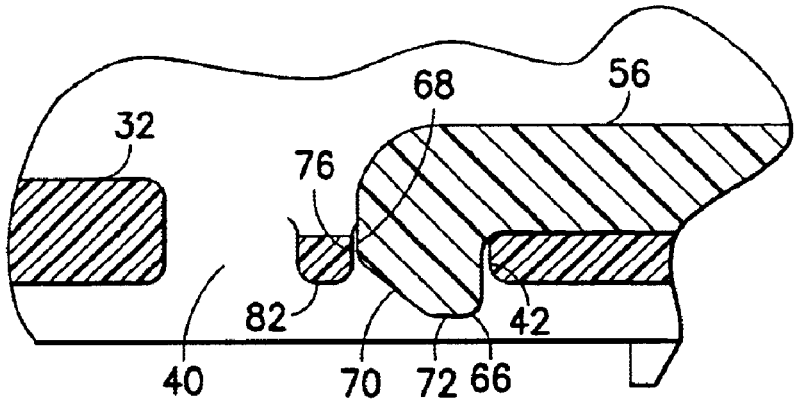
FIG. 5 is a partial cross sectional view of the front end of one of the side arms of the CPA member shown in FIG. 4 and a portion of the side section of the housing of the electrical connector in the position shown in FIG. 1.

Referring also to FIG. 5, the tips 72 are adapted to project into the apertures 40 or 42 of the first housing member 18. More specifically, the tips 72 are adapted to extend out of the apertures 40, 42 past the exterior side of the side sections 32. The first rear position of the CPA member 16 comprises the center section 54 being spaced from the deflectable latch 28 (as seen in FIG. 8) and, the outwardly extending portions 66 of the side arms 56 extending into the rear apertures 42 with the tips 72 extending outward and past the outer lateral sides of the side sections 32 (as seen in FIG. 5). In this first position, the front stop surface 68 is located at a stop surface 76 at the front of the rear aperture 42. The interaction between the stop surface 68 and the stop surface 76 prevents the CPA member 16 from being moved forward from its first position until the electrical connector 10 is connected to its mating electrical connector. The two stop surfaces 68, 76 function as stubbing surfaces to prevent the CPA member from being moved forward on the housing from the first position unless the outwardly extending portions are first moved at least partially towards each other or inwards.

Figure 6:
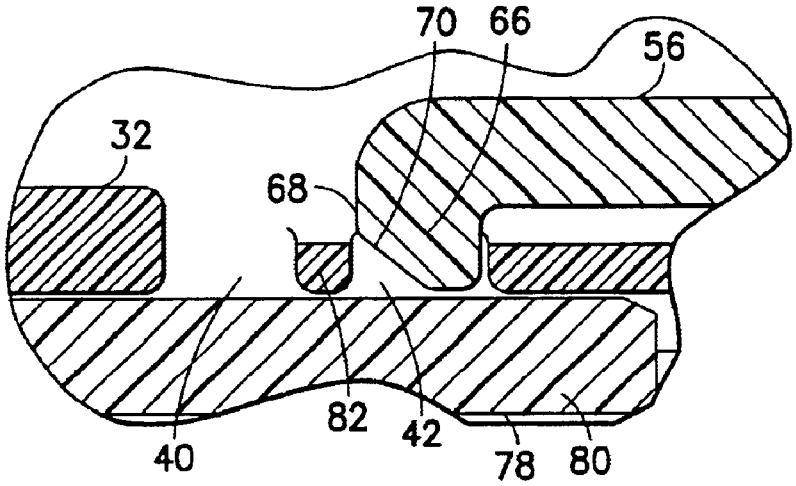
FIG. 6 is a partial cross sectional view as in FIG. 5 with the mating electrical connector shown attached.
Figure 7:
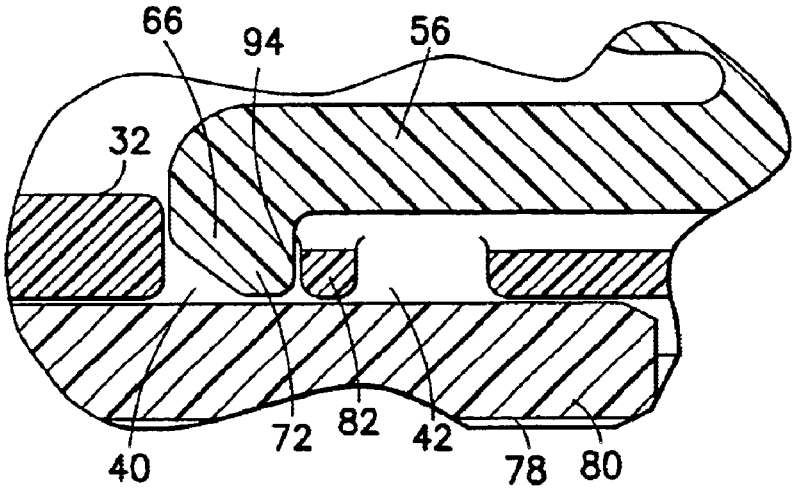
FIG. 7 is a partial cross sectional view as in FIG. 6 with the CPA member moved to a forward position.

Referring now also to FIGS. 6 and 7, when the mating electrical connector 78 is connected to the electrical connector 10, a portion of the housing 80 of the mating electrical connector 78 slides along the lateral exterior side of the side sections 32. As the housing 80 is slid along the side sections 32, the housing 80 comes into contact with the ramp surface 70. This causes the outwardly extending portions 66 to be cammed inward into the rear aperture 42. The stop surface 68 is moved away from the stop surface 76. The ramp surface 70 is now located in front of the stop surface 76. The CPA member 16 can now be pushed forward. The ramp surface 70 allows the outwardly extending portion 66 to cam over the section 82 located between the two apertures 40, 42. When the outwardly extending portion 66 comes into registration with the front aperture 40, the portion 66 can snap into the aperture 40 as shown in FIG. 7. The thickness of the section 82 is smaller than the latch surface 94 such that the portion 66 can be deflected or cammed by deflection out of the front aperture 40 when a user moves the CPA reward.

With the present invention, the CPA member 16 can be moved from its rear inactive position to its front active position only after the mating electrical connector 78 and the electrical connector 10 are fully engaged in a locked position. When the CPA member is moved from its rear position to its front position, as shown in FIG. 10 the center section 54 can be moved into engagement with the rear bottom end of the latch 28. In the embodiment shown, the upper ramp surface 64 of the center section 54 comprises a set of ribs 86 set on an incline. As seen in FIG. 10, once the CPA member 16 has been shifted forward into the active position, a stop pad 88 centrally located on the CPA member positions itself beneath the rear end of the cantilever-beam latch 28 and restricts enough downward motion of the latch 28 to prevent the latch from releasing the two mating connectors. Also as seen in FIG. 10, the ramp surface 64 assists not only in the prevention of downward compression on the latch 28, but also supplies a minimal amount of constant force (as indicated by force arrow 100) directly conversely for the purpose of retaining better positional memory of the latch 28 and, for providing improved surface contact of the latch surface 46 engagement with the housing of the mating electrical connector.

In the embodiment shown, before the mating electrical connector can be disconnected from the electrical connector 10 the CPA member 16 must be moved from its forward position shown in FIG. 10 back to its rear position shown in FIG. 8. Only after the CPA member 16 has been moved to its rear position, with the stop pad 88 now spaced away from the area beneath the rear end 90 of the latch 28, can the latch 28 deflect sufficiently inwardly to disengage the latch projection 44 from the mating electrical connector.

Referring now particularly to FIG. 9, with the present invention the CPA member 16 is prevented from being moved from its rear position to its front position if the latch 28 is in an inwardly deflected position. The latch 28 would be in an inwardly deflected position when the mating electrical connector is not fully connected to the electrical connector 10 (i.e., when the mating electrical connector is only partially mounted onto the housing of the electrical connector 10). With the latch 28 in an inwardly deflected position as shown in FIG. 9, as the CPA member 16 is attempted to be moved forward the lower stop surface 62 of the CPA member 16 will contact the rear end 90 of the latch 28. The rear end 90 of the latch 28 will, thus, block movement of the CPA member to its forward position.

Because the CPA member 16 cannot be moved to its forward position unless the two electrical connectors 10, 78 are fully mated with each other, a user automatically knows whether or not a proper and full connection has been made based upon whether or not the CPA member 16 can be moved to its forward position. In the addition, the CPA member 16 cannot be moved to its forward position unless the housing 80 of the mating electrical connector 78 first cams the outwardly extending portions 66 of the CPA member 16 inward in the apertures 42 to remove the registration between the stop surfaces 68, 76 as shown in FIG. 6. When the two side arms 56 snap into the front apertures 40, the user is provided with a positive tactile lock. The front apertures 40 are designed such that a marginally noticeable increased amount of force is required to disengage the CPA member 16 back to its original preloaded condition. The loop section 50 of the latch 28 provides an aperture to allow a tool to pass through the aperture and press against the front of the center section 54 to assist in moving the CPA member 16 back to its rear position.

As noted above, the CPA member 16 comprises a front ramp surface 64 provided by the stop pad 88. This ramp surface 64 can be used to contact the rear end 90 of the latch 28 to insure that the latch 28 is positioned at a fully outward position. This specifically helps to ensure that the latch 28 retains its resilient spring memory. Although the present invention has been described with reference to an electrical connector comprising contacts which are adapted to be connected to individual electrical conductors or wires, features of the present invention could be adapted for use in any suitable type of electrical connector including, for example, an electrical connector adapted to connect a flex circuit (such as a flexible printed circuit) to another electrical connector.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

a housing;

electrical contacts connected to the housing, the housing comprising a deflectable latch for latching with a mating electrical connector; and a connector position assurance (CPA) member movably attached to the housing, the CPA member comprising two deflectable side arms and a center section located between the side arms, wherein the CPA member is movable between a first position and a second position, wherein the first position comprises the center section being spaced from the deflectable latch and outwardly extending portions of the side arms extending through first holes in the housing to an exterior side of the housing, wherein the second position comprises a portion of the center section being located beneath a portion of the latch, with the latch in a home position, to prevent the latch from being deflected inward, and the outwardly extending portions being moved out of the first holes, and wherein the CPA member is blocked by the latch from moving from the first position to the second position unless the latch is located at the home position.

2. An electrical connector as in claim 1 wherein the center section comprises a general wedge shaped section.

3. An electrical connector as in claim 1 wherein the housing comprises second holes extending through the housing and the second position comprises the outwardly extending portions of the side arms extending through the second holes.

4. An electrical connector as in claim 1 wherein front sides of the first holes and a portion of front sides of the outwardly extending portions comprise stubbing surfaces to prevent the CPA member from being moved forward on the housing from the first position unless the outwardly extending portions are first moved at least partially towards each other.

5. An electrical connector assembly comprising:

a first electrical connector comprising the electrical connector as in claim 1; and a second mating electrical connector having a second housing mounted on the housing of the first electrical connector, wherein the second housing contacts the outwardly extending portions of the side arms and deflects the side arms inward when the second housing is initially mounted to the housing of the first electrical connector.

6. An electrical connector assembly as in claim 5 wherein the housing of the first electrical connector comprises second holes extending through the housing, and the second position comprises the outwardly extending portions of the side arms extending through the second holes.

7. An electrical connector assembly as in claim 6 wherein front sides of the first holes and a portion of front sides of the outwardly extending portions comprise stubbing surfaces to prevent the CPA member from being moved forward on the housing of the first electrical connector from the first position unless the outwardly extending portions are first moved at least partially inward.

8. An electrical connector comprising:

a housing;

electrical contacts connected to the housing, the housing comprising a deflectable latch for latching with a mating electrical connector, a CPA member receiving area located beneath the deflectable latch, the housing comprising first holes and second holes extending laterally outward from the CPA member receiving area; and a connector position assurance (CPA) member movably attached to the housing, the CPA member comprising two deflectable side arms and a center section having a general wedge shaped section and being located between the side arms, wherein the CPA member is movable between a first position and a second position, wherein the first position comprises the center section being spaced from the deflectable latch and outwardly extending portions of the side arms extending through the first holes in the housing to an exterior side of the housing, wherein the second position comprises the wedge shaped section of the center section being located beneath a portion of the latch with the latch in a home position to prevent the latch from being deflected inward and the outwardly extending portions being moved from the first holes to the second holes, and wherein the CPA member is blocked by the latch from moving from the first position to the second position unless the latch is located at the home position.

9. An electrical connector as in claim 8 wherein the general wedge shaped section contacts a bottom side of the latch and wedges the latch in an outward direction.

10. An electrical connector as in claim 8 wherein front sides of the first holes and a portion of front sides of the outwardly extending portions comprise stubbing surfaces to prevent the CPA member from being moved forward on the housing from the first position unless the outwardly extending portions are first moved at least partially inward.

11. An electrical connector assembly comprising:

a first electrical connector comprising the electrical connector as in claim 8; and a second mating electrical connector having a second housing mounted on the housing of the first electrical connector, wherein the second housing contacts the outwardly extending portions of the side arms and deflects the side arms towards each other when the second housing is initially mounted to the housing of the first electrical connector.

12. An electrical connector assembly as in claim 11 wherein front sides of the first holes and a portion of front sides of the outwardly extending portions comprise stubbing surfaces to prevent the CPA member from being moved forward on the housing of the first electrical connector from the first position unless the outwardly extending portions are first moved at least partially inward.

13. An electrical connector comprising:

a housing, the housing comprising a deflectable latch for latching with a mating electrical connector, wherein the latch is resiliently movable from a latching home position in an inward direction;

electrical contacts connected to the housing;

a connector position assurance (CPA) member movably attached to the housing, the CPA member comprising two deflectable side arms and a general wedge shaped section located between the side arms, wherein the CPA member is movable between a first position and a second position;

means for preventing the latch from moving from its latching home position when the CPA member is at the second position;

means for preventing the CPA member from being moved from the first position to the second position unless the latch is at the latching home position; and means for preventing the CPA member from being moved from the first position to the second position unless the housing is mated with a housing of a mating electrical connector;

wherein the first position comprises the wedge shaped section being spaced from the deflectable latch and outwardly extending portions of the side arms extending through first holes in the housing to an exterior side of the housing, and wherein the second position comprises a portion of the wedge shaped section being located beneath a portion of the latch with the latch in a home position to prevent the latch from being deflected inward and the outwardly extending portions being moved out of the first holes.

14. An electrical connector assembly comprising:

a first electrical connector comprising the electrical connector as in claim 13; and a second mating electrical connector having a second housing mounted on the housing of the first electrical connector, wherein the second housing contacts the outwardly extending portions of the side arms and deflects the side arms towards each other when the second housing is initially mounted to the housing of the first electrical connector.

15. An electrical connector assembly as in claim 14 wherein front sides of the first holes and a portion of front sides of the outwardly extending portions comprise stubbing surfaces to prevent the CPA member from being moved forward on the housing of the first electrical connector from the first position unless the outwardly extending portions are first moved at least partially inward.

* * * * *